US008591151B2

(12) United States Patent
Webb et al.

(10) Patent No.: US 8,591,151 B2
(45) Date of Patent: Nov. 26, 2013

(54) FORMING A SHAFT FOR AN UNDERGROUND MINE

(75) Inventors: Rocky Lynn Webb, North Bay (CA); Morris James Medd, London (CA); Ryan George Gough, Callander (CA); John Nicholas De La Vergne, North Bay (CA); Andy Robert Fearn, Corbeil (CA); Fredric Christopher Delabbio, Samford (AU)

(73) Assignee: Technological Resouces Pty. Ltd., Melbourne Victoria (AU)

( * ) Notice: Subject to any disclaimer, the term of this patent is extended or adjusted under 35 U.S.C. 154(b) by 0 days.

(21) Appl. No.: 13/524,644

(22) Filed: Jun. 15, 2012
(Under 37 CFR 1.47)

(65) Prior Publication Data

US 2012/0318581 A1 Dec. 20, 2012

Related U.S. Application Data

(63) Continuation of application No. 13/380,727, filed as application No. PCT/AU2010/000820 on Jun. 30, 2010, now abandoned.

(30) Foreign Application Priority Data

Jun. 30, 2009 (AU) ..... 2009903054

(51) Int. Cl.
*E21D 1/03* (2006.01)

(52) U.S. Cl.
USPC ..... 405/133; 405/138; 405/148

(58) Field of Classification Search
USPC ..... 405/132, 133, 138, 148
See application file for complete search history.

(56) References Cited

U.S. PATENT DOCUMENTS

| | | | | | |
|---|---|---|---|---|---|
| 2,743,830 | A | * | 5/1956 | Bares | 414/565 |
| 3,185,226 | A | * | 5/1965 | Robbins | 405/133 |
| 3,675,433 | A | * | 7/1972 | Silvestrov et al. | 405/138 |
| 3,965,995 | A | | 6/1976 | Sugden | |
| 4,494,617 | A | * | 1/1985 | Snyder | 175/86 |
| 4,601,607 | A | * | 7/1986 | Lehmann | 405/133 |

(Continued)

FOREIGN PATENT DOCUMENTS

| | | |
|---|---|---|
| DE | 1 608 290 | 12/1970 |
| GB | 2 158 129 A | 11/1985 |
| WO | WO 2005/049966 A1 | 6/2005 |
| WO | WO 2010/012290 A1 | 2/2010 |

OTHER PUBLICATIONS

International Search Report mailed Aug. 31, 2010, from the Australian Patent Office for International Application No. PCT/AU2010/000820.

(Continued)

*Primary Examiner* — Frederick L Lagman
(74) *Attorney, Agent, or Firm* — Banner & Witcoff, Ltd.

(57) ABSTRACT

In forming a mine shaft for an underground mine, earth excavated by a boring machine may be transported upwardly by a handling unit to a transfer station where it may be transferred into skips, which may be raised and lowered along skip guides within the shaft hole for transport of the excavated material to an earth surface region. The transfer station may be moved downwardly as excavation progresses.

21 Claims, 4 Drawing Sheets

(56) References Cited

U.S. PATENT DOCUMENTS

| | | | | |
|---|---|---|---|---|
| 4,646,853 | A | 3/1987 | Sugden et al. | |
| 6,428,245 | B1 * | 8/2002 | Reid | 406/197 |
| 6,634,832 | B2 * | 10/2003 | Reid | 406/50 |
| 2007/0273196 | A1 * | 11/2007 | Vergne | 299/95 |
| 2012/0200139 | A1 * | 8/2012 | Delabbio et al. | 299/18 |

OTHER PUBLICATIONS

Douglas, A., et al., "Sinking Contractor's Close Out Presentation on Completion of South Deep Shafts," The Third South African Conference on Base Metals, pp. 455-470.

International Preliminary Report on Patentability dated Jun. 24, 2011, for International Application No. PCT/AU2010/000820.

* cited by examiner

FORMING A SHAFT FOR AN UNDERGROUND MINE

CROSS REFERENCE TO RELATED APPLICATIONS

This is a continuation of U.S. application Ser. No. 13/380,727, filed Dec. 23, 2011, which is the U.S. national phase application of International Application No. PCT/AU2010/000820, filed Jun. 30, 2010, which claims the priority of Australian Patent Application No. 2009903054, filed Jun. 30, 2009, the content of both of which is incorporated herein by reference.

FIELD OF THE INVENTION

This invention relates to the formation of shafts for underground mines. It has particular but not exclusive application to the formation of a mine shaft through which to provide access to underground mining activity and extraction of mined material after the mine shaft has been formed but it may also have application to the formation of shafts for other purposes such as for use as ventilation shafts for underground mines.

BACKGROUND OF THE INVENTION

Modern large block cave mines require a significant time to develop and a very significant early investment. Both of these factors make their financial success in terms of net present value extremely sensitive to the speed at which they can be brought on stream. Deep cave mines require shaft access and the development of this shaft access forms the initial part of the mine development and therefore is directly on the project critical path i.e. until the initial shafts are completed no other underground development activity can be commenced.

Traditional shaft sinking operations are carried out by drilling and blasting to excavate material to form a hole and removing the excavated material by a mucking system by which the excavated material is picked up and deposited in kibbles which are hoisted to the surface on cables run to head gear and a winder installed at the surface of the mine. This mucking operation requires skilled operators and is inherently dangerous to miners required to guide and operate equipment at the bottom of the shaft as it is being formed. Moreover, the speed at which the excavated material can be removed is limited by the need to cease operations for drilling and blasting, the difficulty of loading variable sized material into the kibbles and the limited speed at which the kibbles can be hoisted and lowered as they tend to move about on the very long lengths of cable as sinking progresses.

There have been proposals to increase the speed at which sinking can progress by using earth boring machinery. For example, U.S. Pat. No. 3,965,995 of Sugden which discloses a proposal to use a cutter wheel which rotates about a horizontal tubular support, where the cutting are directed into the tubular support to be received by an endless bucket which carries them up to a discharge station. Another example is U.S. Pat. No. 4,589,502 of Salter et al which discloses a proposal to use a shaft sinking apparatus which employs an earth boring machine having a rotary cutting head and a bucket conveyor for carrying cuttings to a feed bin installed on the boring machine from which the cuttings can be fed into a skip which is lifted by a crane to the ground surface. However, these prior art proposals still involve the direct filling of kibbles, buckets or skips and the operational speed and capacity from such systems is thus limited by having such filling devices on station, ie if there is no filling device at the discharge station for such earth boring machinery, the machines must temporarily cease cutting until another filling device is available. The present invention enables development of a more robust and effective removal system which allows the continued supply of excavated material to continue from such machines even if filling devices are not on station.

SUMMARY OF THE INVENTION

According to the invention there is provided a method of removing excavated material from a mine shaft during formation of the mine shaft for an underground mine, comprising;

- transporting excavated material upwardly on a substantially continuous basis from an excavation region of the shaft to a transfer station above the excavation region;
- depositing the transported excavated material into at least one storage bin located at the transfer station;
- intermittently discharging excavated material from the storage bin into a skip moveable up and down along a skip guide within the shaft to deposit a discrete load of excavated material into the skip;
- hoisting the skip upwardly through the shaft to an earth surface region;
- discharging the load of excavated material from the skip at said surface region and lowering the skip back to the transfer station to receive a further discrete load of excavated material from the storage bin; and
- moving the transfer station and storage bin periodically downwardly within the shaft as excavation proceeds.

The storage bin may be one of a plurality of such bins at the transfer station and the skip may be one of a like plurality of skips lowered and hoisted through the hole on guides to receive and transport material from the bins. More specifically, there may be a pair of storage bins at the transfer station and a pair of skips moveable up and down within the shaft along adjacent pathways sequentially to receive discrete loads of excavated material and to transport those loads to the earth surface region for discharge at the earth surface region and then to return downwardly to the transfer station.

The skips may be constrained by respective skip guides to move along pathways disposed within a side segment of the shaft having a cross-sectional area which is less than 50% of the cross-sectional area of the shaft.

The excavated material may be transported to the transfer station by a conveyor associated with the transfer station.

The conveyor may have a vertically moveable lower end which is moved downwardly through a limited distance as excavation proceeds before moving the transfer station.

The periodic movement of the transfer station may be in response to installation of shaft lining extensions below the transfer station.

The invention further provides a method of forming a mine shaft for an underground mine, comprising:

- excavating earth to form a hole extending downwardly from an earth surface region; and
- removing excavated material from the shaft by the above defined method.

The excavation of earth may be performed by an earth boring machine comprising a rotary cutting head.

The hole may be lined progressively with a shaft lining incorporating a guide for the or each skip by installation of successive lining and skip guide extensions below the transfer station so as to extend the lining and the skip guide for the or each extension of lining in advance of skip movements downwardly along the extensions.

The invention further provides apparatus for removing excavated material from a mine shaft during formation of the shaft, comprising:

an extendible conveyor for transporting excavated material upwardly from an excavation region to a transfer station;

at least one storage bin located at the transfer station to receive excavated material from an upper part of the conveyor; and a skip moveable up and down on a skip guide within the shaft intermittently to receive discrete loads of excavated material from the storage bin at the transfer station and transport that material to an earth surface region for discharge at the surface region.

The invention also extends to apparatus for forming a mine shaft for an underground mine, comprising:

an excavator for excavating earth to form a hole extending downwardly from an earth surface region; and an apparatus as defined above for removing earth excavated by the excavator.

BRIEF DESCRIPTION OF THE DRAWINGS

In order that the invention may be more fully explained, one particular embodiment will be described in detail with reference to the accompanying drawings in which.

DETAILED DESCRIPTION OF THE PREFERRED EMBODIMENT

Figure 1:
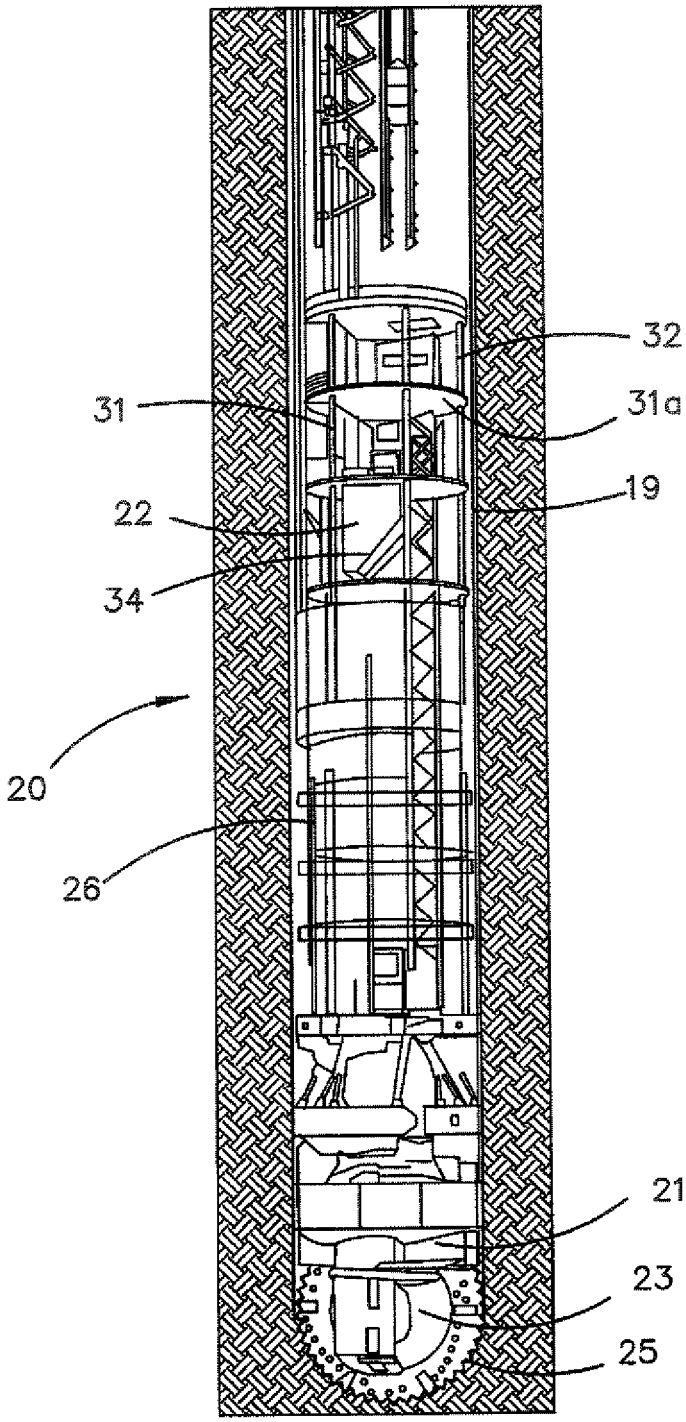
FIG. 1 illustrates a shaft sinking system constructed and operated in accordance with the present invention.

The drawings illustrate a mine shaft boring apparatus denoted generally as 20 located in a shaft hole 19. This apparatus comprises a boring machine 21 and an excavated material handling unit 22 disposed above the boring machine and operable to receive excavated material from the boring machine and to transfer it to skips for transport to ground level and discharge at ground level to appropriate conveying equipment or other transport for disposal.

Earth boring machine 21 has a rotary cutting head 23 fitted with cutters 25 and is mounted at the lower end of a main machine frame 26. The cutter head is rotatable about a vertical axis so that the machine is operable to bore a generally cylindrically shaped hole. Bucket conveyors 45, 46 transport the excavated material from the cutter head upwardly to the material handling unit 22 disposed above the boring machine.

The main machine frame 26 can be stabilised or locked into position within the bored hole by operation of hydraulically actuated stabilising jacks 27, 28 which operate upper and lower grippers 29, 30 to grip the sidewalls of the shaft to stabilise the position of the boring machine in the shaft. The boring machine can be advanced downwardly by incremental advancement of the main frame 26 by operation of the stabilising jacks 27, 28 and grippers 29, 30 in known fashion.

Material handling unit 22 comprises a galloway or main frame 31 formed by a series of platforms or decks 31*a* interconnected by circumferentially spaced vertical studs 32.

Galloway 31 may be lowered into the shaft on cables and is supported independently of boring machine 21.

Material handling unit 22 comprises a material transfer station 33 including a pair of storage bins in the form of hoppers 34 mounted side by side on galloway 31. The galloway also supports a bucket conveyor 46 which transports excavated material from boring machine 21 upwardly through the shaft to a location above the transfer station from which it discharges the excavated material onto discharge ramps 35 and into the bins 34. Conveyor 46 is operated while cutter head 23 is cutting to feed the excavated material into the bins and the material is discharged sequentially from the bins into a pair of skips 36 hoisted on cables 40 from ground level and fitted with wheels 37 which run on vertical guides 38 fitted to the shaft in the manner to be described below.

Figure 6:
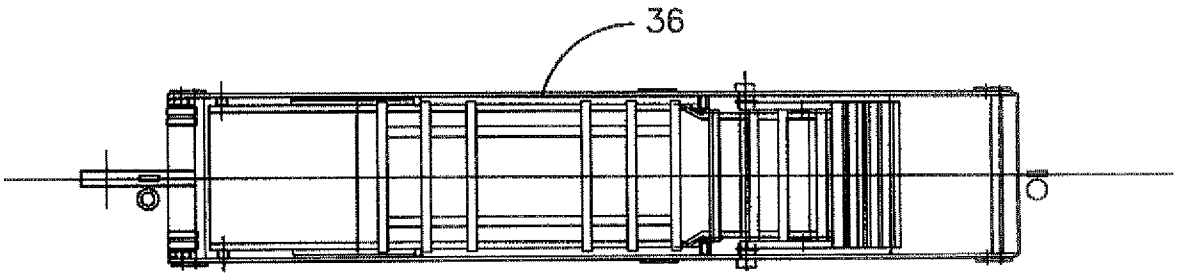
FIGS. 6 and 7 illustrate the construction of a pair of skips and skip guides incorporated in the system.
Figure 7:
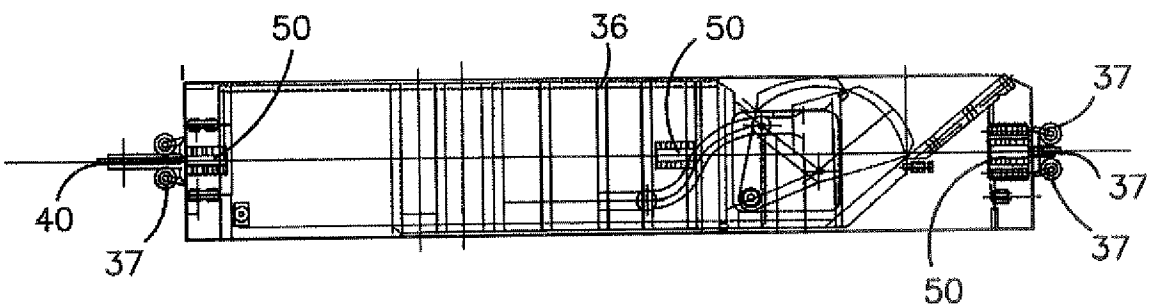

Skips 36 may be arc gate bottom dump skips as shown in FIGS. 6 and 7. The top and bottom of each skip is fitted with two sets of wheels 37 to run on three sides of the respective vertical guides 38. Each skip is also fitted with open channel runners 50 lined with wear blocks to run along the guide.

Skips 36 are operated in tandem so that as one skip is hoisted from the transfer station 33 to ground level, the other skip is lowered to the loading station. When a skip 36 reaches the loading station the bottom floor of the respective bin 34 is moved to discharge material stored in the bin through discharge opening 39 into the skip. The contents of the bin empties quickly to discharge a predetermined discrete load of material into the skip and the bottom door of the bin is closed. Each bin has sufficient capacity to accumulate material from conveyor 46 as the skip is hoisted to the surface, its contents discharged by opening the bottom arc gate and the skip relowered to the loading station to receive another discrete load of material.

Skips 36 are formed as long rectangular containers which are disposed so as to extend vertically along a side section or segment 52 of the shaft. This section of the shaft, which occupies considerably less than 50% of the shaft cross-section may be divided from the remainder of the shaft space by steel formwork carrying the skip guides 38 and set into a shaft lining 42 installed within the shaft as boring progresses. Typically the maximum width side segment 52 of the shaft may be no more than about one third of the shaft diameter.

Figure 2:
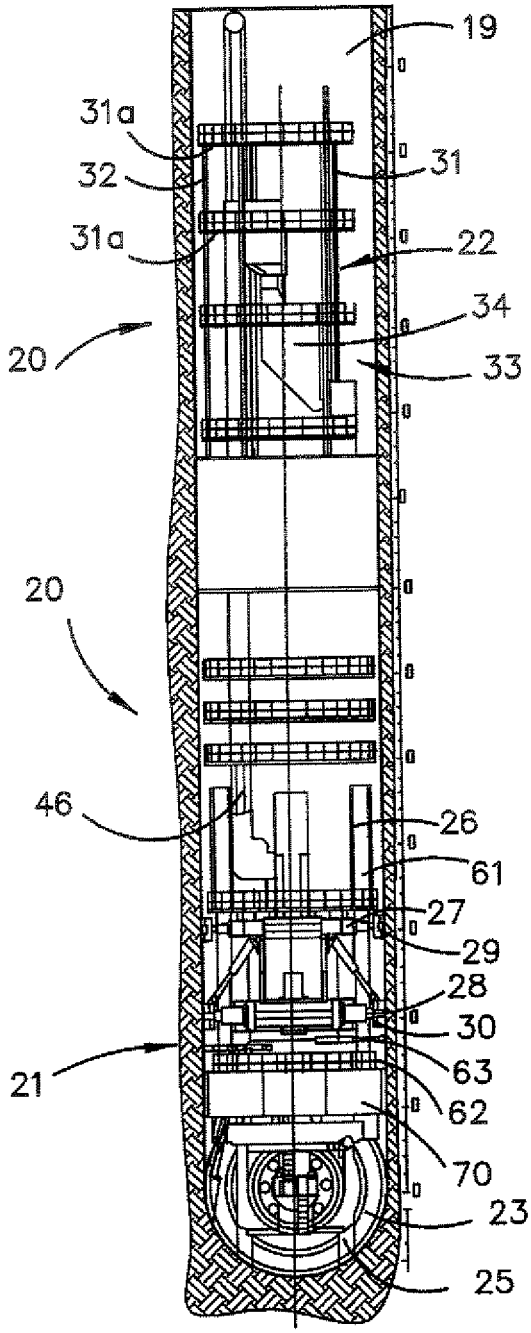
FIG. 2 is a vertical cross-section through the shaft sinking system.
Figure 3:
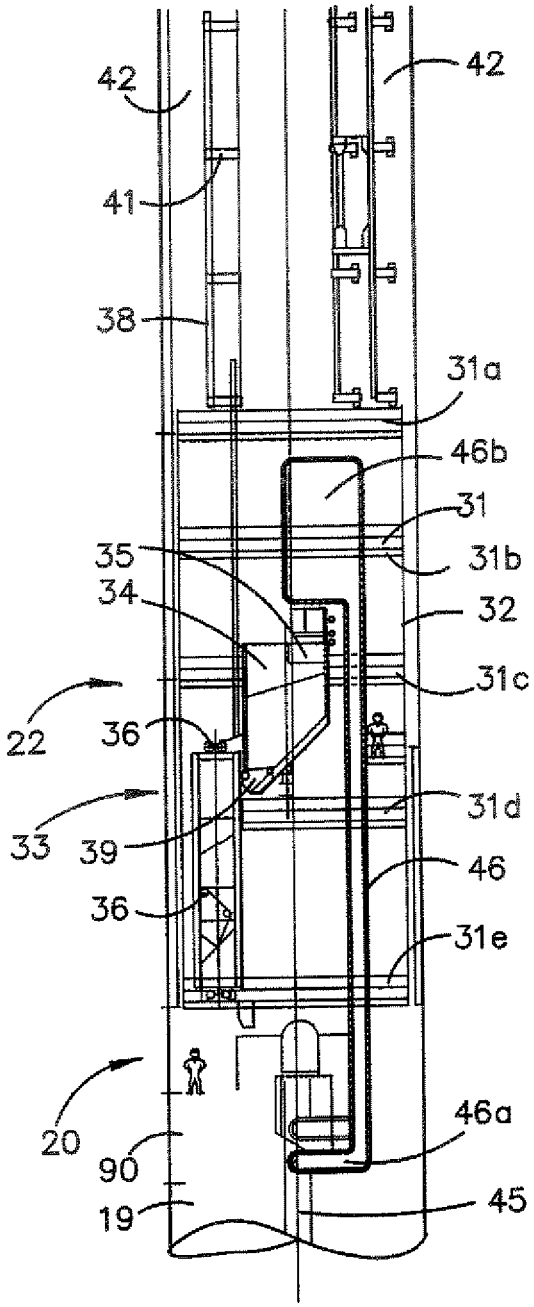
FIG. 3 is a vertical cross-section through an upper part of the system.
Figure 4:
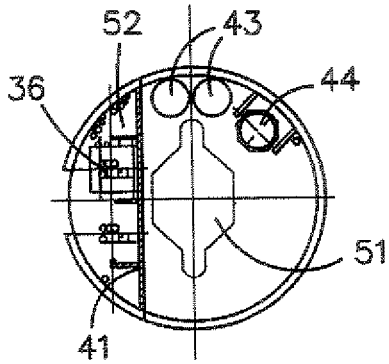
FIGS. 4 and 5 are horizontal cross-sections through the upper part of the system.
Figure 5:
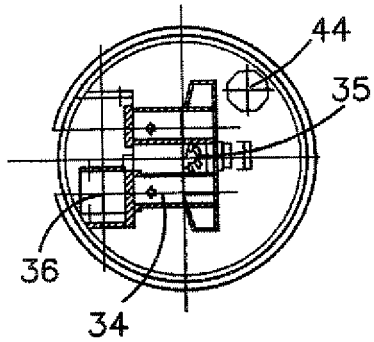

As shown in FIGS. 2 and 3, the shaft may be fitted with air ducts 43 and a delivery bucket or lift 44 for delivery of men and materials to the decks of galloway 34 and the mainframe of the boring machine, a central region 51 of the shaft remaining available as a heave lift compartment.

Because skips 36 are constrained to run on guides which are firmly anchored to the shaft lining through the formwork 41 they can be of very robust construction and can be raised and lowered along the guides and within the protective formwork much more rapidly than the receptacles previously used for transmitting excavated material to the surface. The lining 42 may be formed of concrete and to enable progressive extension of the lining and the guides for the skips the shaft lining and skip guides may be extended by installation of successive lining and skip guide extensions below the transfer station 33 while material is being conveyed and transferred in advance of movements of the skips into the extensions of the lining as shaft sinking proceeds.

As shaft boring operations proceed the boring machine may be advanced in successive increments by alternate operation of the stabilising jacks 27, 28 to allow the machine to move down the hole. The bottom end of conveyor is vertically extensible by movement of a bottom loop 46*a* of the conveyor with compensating movement of an upper loop 46*b* to allow continued transport of excavated material by the conveyor to the transfer station and discharge into hoppers 34 without moving the transfer station as the cutter head of the boring machine and the conveyor 45 moves through a limited distance. During this time, an extension of the shaft lining 42 (not shown) can be installed below the transfer station, more specifically, on the platforms or decks Immediately below the lowermost positions of the skips 36 in the lining installation zone 90 during the then current material transfer and hoisting operations.

The lining may be installed by spraying concrete directly onto the bored hole through a slick line extending from the surface and supplying concrete through a distributor to one or more, typically two, manually operated application hoses. Alternatively, the concrete can be poured into formwork instead of being sprayed or the lining can be assembled from precast components and attached to the wall by bolting or other convenient means. Extensions of the skip guides and skip guide formwork can then be installed so as to be firmly anchored to the lining. The unit 22 can then be lowered so that the loading station is lowered and the skips 36 allowed to run onto the extended guides within the extended lining. If the lining is applied in wet form to the bore hole by spraying or other means, sufficient time will need to be allowed for the concrete to cure before the loading station is lowered.

As the transfer station is supported independently of the boring machine it can be moved in incremental steps or substantially continuous movements which may or may not match the movements of the boring machine. Typically such movements will be in response to the need to reposition to do another extension of the shaft lining.

The invention enables the development of a material transfer and hoisting system as the hole progresses using skips which can be robust and can be hoisted and lowered more rapidly than kibbles and other unguided receptacles. The illustrated system is capable of moving excavated material at a rate equal to that required for removal of material in an operating mine. The capacity will depend on the size of the hoist at the surface and the depth of the shaft but a typical installation should be capable of moving at least 4,500 tonnes of excavated material per day. Accordingly, the transfer station and skip hoisting equipment as installed during the shaft sinking operation may be left in position and subsequently used for retrieving material from a subsequently developed operating mine.

The illustrated system has been advanced by way of example only and it could be modified considerably including various skip guide arrangements. Various kinds of boring machines could be used in an apparatus or method in accordance with the invention. Such boring machines could use various types of cutters or may employ hydraulic or other types of excavation. The excavation may alternatively be carried out by drilling and low energy blasting operations for example by drilling small closely spaced holes filled with low energy charges. The excavated material may be picked up for transport to the transfer station by any appropriate means such as by water slurry transport. It would also be possible to install a material sizing unit on the excavator to crush or otherwise size the excavated material to a condition suitable for loading onto the bottom end of the conveyor transporting it to the transfer station.

It is to be understood that these and many other modifications and variations may be made without departing from the scope of the invention and the appended claims.

The invention claimed is:

1. A method of removing excavated material from a mine shaft during formation of the mine shaft for an underground mine, comprising:

transporting excavated material upwardly on a substantially continuous basis from an excavation region of the shaft to a transfer station above the excavation region;

depositing the transported excavated material into a plurality of storage bins located at the transfer station such that transported excavated material is temporarily stored in the bins to build static discrete bin loads of material;

cyclically discharging the discrete bin loads of excavated material from the plurality of storage bins into a plurality of skips associated one with each of the storage bins, the skips being moveable up and down along skip guides within the shaft;

cyclically hoisting each skip after it receives a discrete bin load of excavated material from the respective associated bin to an earth surface region, discharging the load of excavated material from the skip at the surface region and lowering the skip back to the transfer station to receive a further discrete bin load of material from the respective associated bin; and periodically repositioning the transfer station and storage bins at successively downwardly displaced locations in the shaft as excavation proceeds.

2. The method as claimed in claim 1, wherein there is a pair of said storage bins at the transfer station and a pair of said skips moveable up and down in the shaft along adjacent pathways sequentially to receive the discrete bin loads of excavated material and to transport those loads to the earth surface region for discharge at the earth surface region and return downwardly to the transfer station.

3. The method as claimed in claim 1, wherein the skips are constrained by the skip guides to move along pathways disposed within a side segment of the shaft having a cross-sectional area which is less than 50% of the cross-sectional area of the shaft.

4. The method as claimed in claim 1, wherein the excavated material is transported to the transfer station by a conveyor associated with the transfer station.

5. The method as claimed in claim 4, wherein the conveyor has a vertically moveable lower end which is moved downwardly through a limited distance as excavation proceeds between the periodic repositioning of the transfer station.

6. The method as claimed in claim 1, wherein the periodic repositioning of the transfer station is in response to installation of shaft lining extensions below the transfer station.

7. A method of forming a mine shaft for an underground mine comprising:

excavating earth to form a hole extending downwardly from an earth surface region; and removing excavated material from the shaft by the method as claimed in claim 1.

8. The method as claimed in claim 7, wherein the excavation of earth is performed by an earth boring machine.

9. The method as claimed in claim 8, wherein the earth boring machine comprises a rotary cutting head.

10. The method as claimed in claim 9, wherein the rotary cutting head has a series of cutter elements rotated about a horizontal axis to excavate material from the earth.

11. The method a claimed in claim 10, wherein the cutter head is rotated about a vertical axis so as to bore a generally cylindrical hole.

12. The method as claimed in claim 1, wherein the hole is lined progressively with a shaft lining incorporating said skip guides for installation of successive lining and skip guide extension below the transfer station so as to extend the lining and the skip guides in advance of downward repositioning of the transfer station.

13. An apparatus for removing excavated material from a mine shaft during formation of the shaft, comprising:

a conveyor for transporting excavated material upwardly from an excavation region to a transfer station;

a plurality of storage bins located at the transfer station to receive excavated material from an upper part of the conveyor such that transported excavated material is temporarily stored in the bins to build static discrete bin loads of excavated material; and a plurality of skips associated one with each of the storage bins and moveable up and down on skip guides within the shaft each cyclically to receive discrete bin loads of excavated material from a respective one of the storage bins at the transfer station, to transport that material to an earth surface region for discharge at the surface region and to return to the storage station to receive further excavated material.

14. The apparatus as claimed in claim 13, wherein there is a pair of said storage bins and a pair of said skips.

15. The apparatus as claimed in claim 13, wherein the skips are constrained by the skip guides to move along pathways disposed within a side segment of the shaft having a cross-sectional area less than 50% of the shaft.

16. An apparatus for forming a mine shaft for an underground mine, comprising:

an excavator for excavating earth to form a hole extending downwardly from an earth surface region; and an apparatus as claimed in claim 13, for removing earth excavated by the excavator.

17. The apparatus as claimed claim 16, wherein the excavator comprises a rotary cutting head.

18. The apparatus as claimed in claim 17, wherein the rotary cutting head has a series of earth cutters rotatable about a generally horizontal axis.

19. The apparatus as claimed in claim 17, wherein the cutting head is rotatable about a vertical axis so as to form a generally cylindrical hole.

20. The apparatus as claimed in claim 16, wherein the excavator is operable to move downwardly in the mine shaft independently of the storage station and the conveyor has a lower end which is moveable vertically through a limited distance to continue to receive excavated material during downward movement of the excavator relative to the storage station.

21. The apparatus as claimed in claim 16, wherein the storage bins are carried on a frame supportable on a frame support operable to periodically reposition the frame and storage bins at successively downwardly displaced new locations.

* * * * *